US006592424B1

(12) United States Patent
Christianson

(10) Patent No.: US 6,592,424 B1
(45) Date of Patent: Jul. 15, 2003

(54) DEVICE AND METHOD FOR SECURING MOVABLE SECTIONS OF WIND INDICATOR DEVICES AND KITES

(75) Inventor: James Christianson, Colchester, CT (US)

(73) Assignee: Go Fly a Kite, Clinton, CT (US)

( * ) Notice: Subject to any disclaimer, the term of this patent is extended or adjusted under 35 U.S.C. 154(b) by 0 days.

(21) Appl. No.: 10/202,016

(22) Filed: Jul. 25, 2002

(51) Int. Cl.[7] ..... A63H 33/40
(52) U.S. Cl. ..... 446/201; 446/218; 446/236
(58) Field of Search ..... 446/176, 199, 446/201, 217, 218, 236; 244/153 A; 40/440; 24/457, 570, 571

(56) References Cited

U.S. PATENT DOCUMENTS 1,583,881 A 5/1926 Heberling
1,669,748 A 5/1928 Greger
2,086,361 A 7/1937 Kaszas
4,227,406 A 10/1980 Coffey
5,127,358 A 7/1992 Galloway et al.
5,149,020 A * 9/1992 Rundle et al. ..... 244/153 A
5,241,777 A * 9/1993 Looker et al. ..... 43/124
5,811,673 A 9/1998 Kwok et al.
6,206,747 B1 * 3/2001 Skwarek ..... 446/217
6,475,056 B1 * 11/2002 Christianson ..... 446/201

* cited by examiner

*Primary Examiner*—Jacob K. Ackun
(74) *Attorney, Agent, or Firm*—Jonathan Grant; Grant Patent Services

(57) ABSTRACT

The invention discloses colorful wind indicator toys and kites having an improved mechanism for securing a hollow rotatable rod containing mechanisms for various rotatable wind collecting parts of the wind indicators and kites. More specifically, it is proposed that a snap lock be used instead of a disk type structure to secure certain hollow rotatable rods onto the frames of wind indicator toys, thereby preventing rods from disengaging and flying away from the structure during high winds.

9 Claims, 5 Drawing Sheets

DEVICE AND METHOD FOR SECURING MOVABLE SECTIONS OF WIND INDICATOR DEVICES AND KITES

BACKGROUND OF THE INVENTION

1. Field of the Invention

This invention discloses a snap lock to secure the attachments of movable parts to a wind wheel and kites.

2. Description of the Prior Art

In the past, there have been a number of inventions relating to amusement devices based on wind power.

U.S. Pat. No. 1,583,881 (J. Heberling) discloses a pinwheel having a relatively rigid metal center, flexible nonmetallic blades fastened to the center, with each of the blades being individual and being cut as a blank separate from the remaining blades, a portion of each of the blades being curved over the metal center.

U.S. Pat. No. 1,669,748 (G. G. Greger) discloses a pin wheel having a wheel made from a blank provided with curved slits to form a plurality of tapering blades. The wheel has its central portion mounted on the pin with the blade tips brought together on the pin in spaced relation to the central portion of the wheel blank. A baffle on the pin rests against the edges of the gathered tip portions.

U.S. Pat. No. 5,487,691 (Chiu) discloses a sphere and rod construction toy which comprises generally spherical construction members having threaded openings provided thereon and rod members having extensible and contractible screw members provided at each end thereof. Five threaded openings are disposed at both the upper and lower hemispheres of the spherical members. One of the five threaded openings is disposed along a central vertical axis whereas the other four at an angle of 45 degree from the axis. Four to eight threaded openings are disposed along the equator of the spherical members. Each end of the rod member has an extensible and contractible screw and a screw fastening device. A variety of patterns, models, and objects can be constructed by using the spherical and rod construction members.

U.S. Pat. No. 3,960,346 (Cho) discloses a kite including a lightweight sheet material and a support structure. The sheet material is secured to the support structure. The support structure has at least one end thereof provided with a threaded profile. A threaded fastener is rotatably positionable on the support member to thereby balance the weight of the kite.

U.S. Pat. No. 5,811,673 (Kwok et al.) discloses a wind direction indicator having a rotatable wind vane and a support for connection to the mast of a yacht. The vane is connected to the support by means of a gimbal mechanism and a stabilizing weight is connected to the gimbal mechanism diametrically opposite the vane.

U.S. Pat. No. 4,227,406 (Coffey) discloses a wind direction device for attachment to a boat shroud for indicating the direction of the wind relative to the direction of travel of the boat. The device includes several wraps of adhesive tape around a boat shroud to form an upwardly facing shoulder at a midpoint of the shroud of the boat, a bearing resting on the shoulder and having a hold through which is received the shroud, which bearing as a slit in one side and is sufficiently flexible and resilient so that the size of the slit can be varied to position the bearing around the shroud and retain the bearing on the shroud.

U.S. Pat. No. 5,127,358 (Galloway et al.) discloses an apparent wind direction indicator having a masthead device for sailboats. These marks can be adjusted with greater compass accuracy to allow several settings in each quadrant creating a series of reference points enabling one to more accurately determine the apparent wind angle from a center point and thus optimize sail trim, heading and boat speed.

U.S. Pat. 2,086,361 (W. B. Kaszas) discloses an airplane kite with a fan wheel mounted on an extended part of the kite.

U.S. Pat. 6,206,747 (Skwarek) discloses a colorful wind indicator which comprises a tail section for catching wind, a front section for indicating the direction of the wind, a tail mounting section for mounting the tail section, a joinder for joining the tail mounting section with the front section and a pole upon which the assembly rotates. The device taught by this patent (herein incorporated by reference) further comprises two disk type structures, with one of the disk type structures being positioned at a proximal end of said hollow rod closest to said pivot doll, and the other disk type structure being positioned at a distal end of the hollow rod farthest away from said pivot doll, with the disk type structures having a plurality of holes around the circumference of each disk type structure. The wind wheel further comprises vanes for catching the wind, with the vanes having a frame which had projections which fit into the disk type structures. In one embodiment, the ends of the projections are bulbous, and fit into appropriately grooved disk type structures.

The hollow rod, to which the disk type structures holding the wind vanes is attached, and which is fitted over and can rotate about a rigid piece, is secured by the use of a cap. However, sometimes this cap can come off, whereupon the hollow rod can fall off of the rigid piece. Without the hollow rod which holds, by means of the disk type structures the wind vanes, the wind wheel is rendered less useful and less ornamental.

SUMMARY OF THE INVENTION

The proposed invention solves these problem by using a snap lock at the end of the rigid piece. More specifically, it is proposed that a groove be circumferentially positioned near the distal end of the rigid piece. A locking mechanism shaped like a washer but having inner structures which securely snap into the groove is placed over the distal end of the rigid piece. The inner structures fit securely into the groove, insuring that the rotatable structures already positioned on or over the rigid piece do not fall off or are not blown off of the kite or the wind wheel.

In one embodiment of the invention, the snap lock has an integrally connected inner circular catch section which is fitted over the rigid piece, whereupon the inner circular catch section "snaps" into the groove positioned on the rigid piece.

In another embodiment of the invention, the snap lock mechanism has an integrally connected sectional catch section which is fitted over the rigid piece, whereupon the inner sectional catch sections "snap" into the groove positioned on the rigid piece.

DETAILED DESCRIPTION OF THE INVENTION

Figure 1:
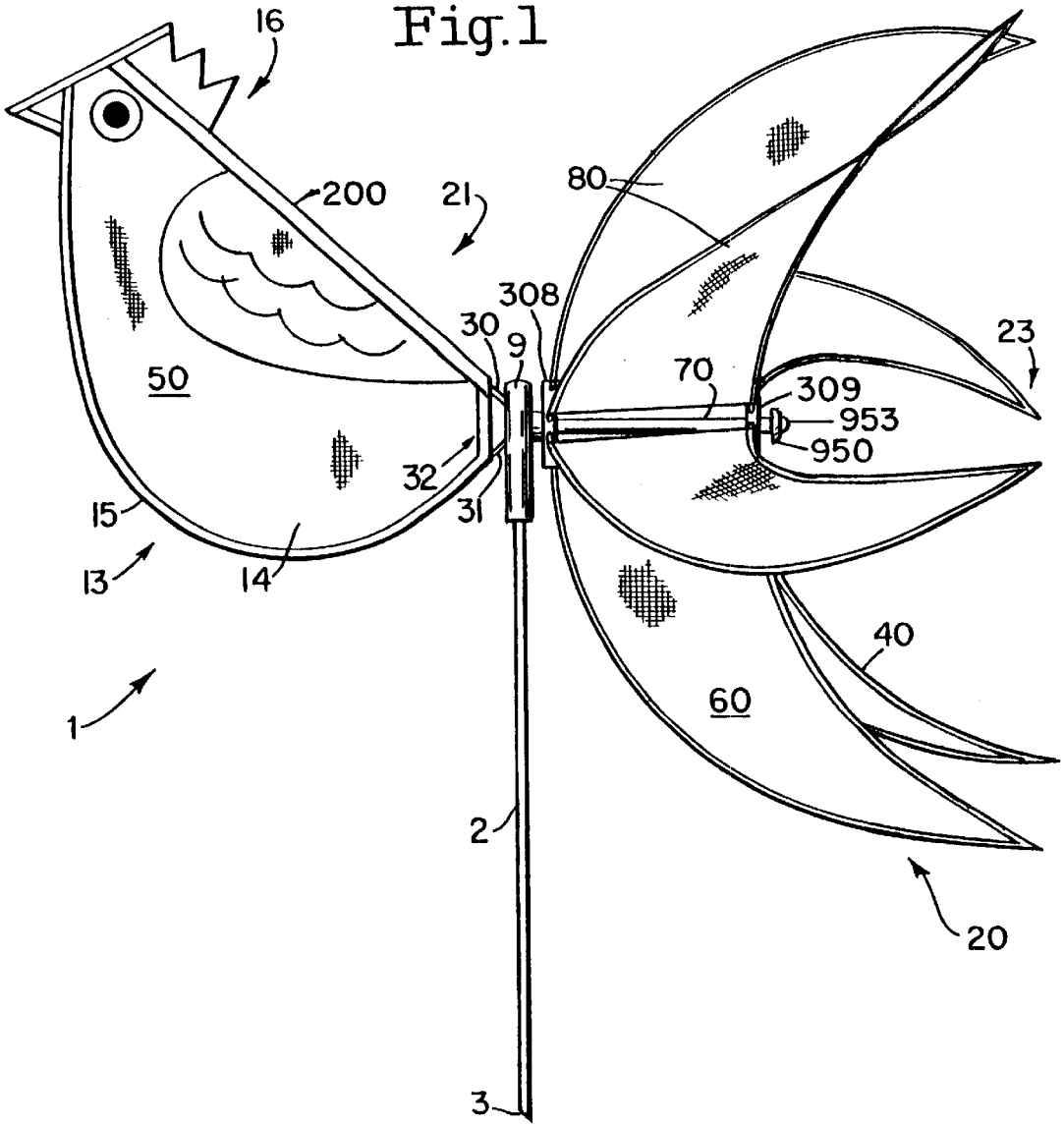
FIG. 1 is a perspective view of the wind wheel.
Figure 4:
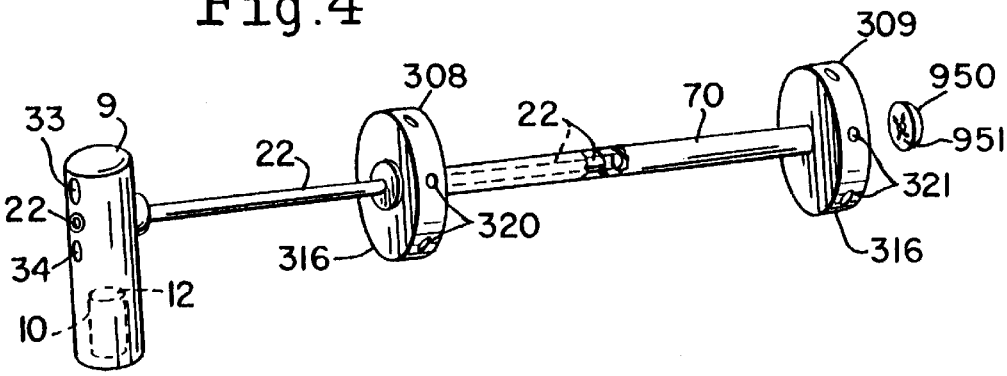
FIG. 4 is a perspective of the support for the back the section of the wind wheel.
Figure 2:
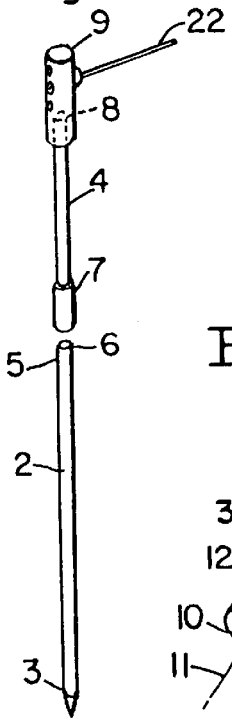
FIG. 2 is a perspective view of the ground stake.
Figure 3:
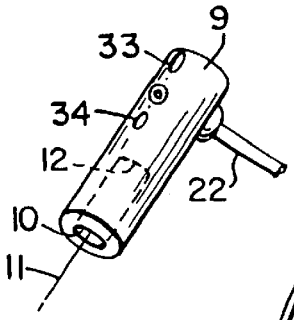
FIG. 3 is a perspective of the hollow doll.
Figure 5:
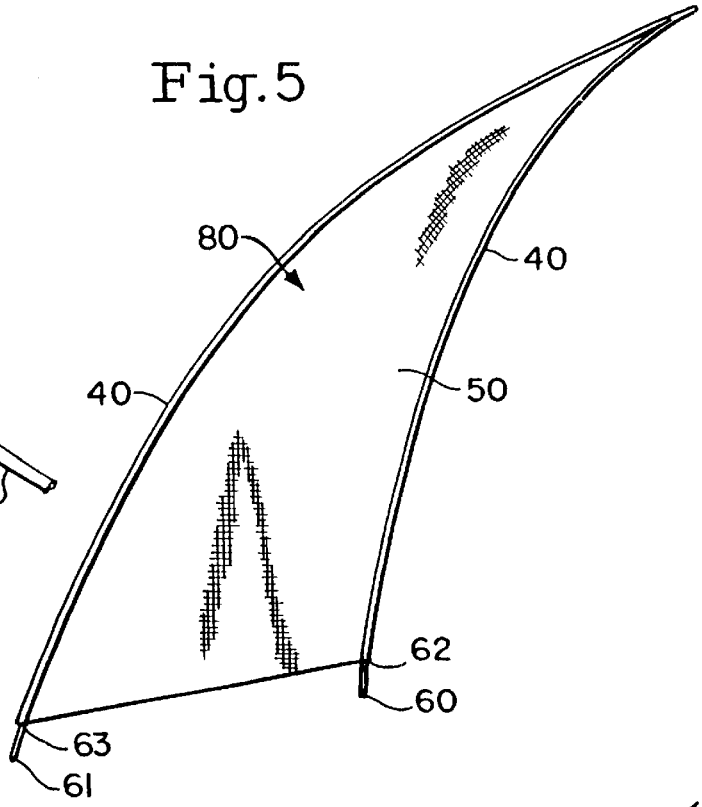
FIG. 5 is a side view of the vane.
Figure 6:
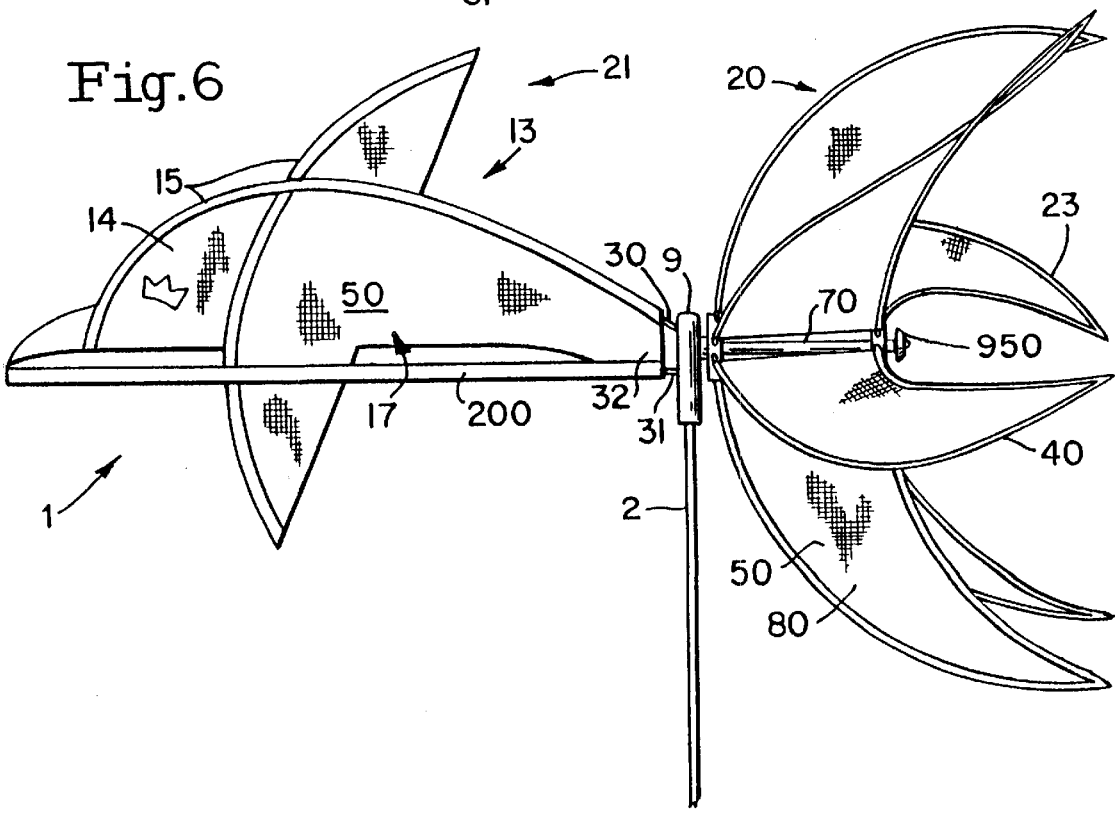
FIG. 6 is a side view of another embodiment of the invention.
Figure 7:
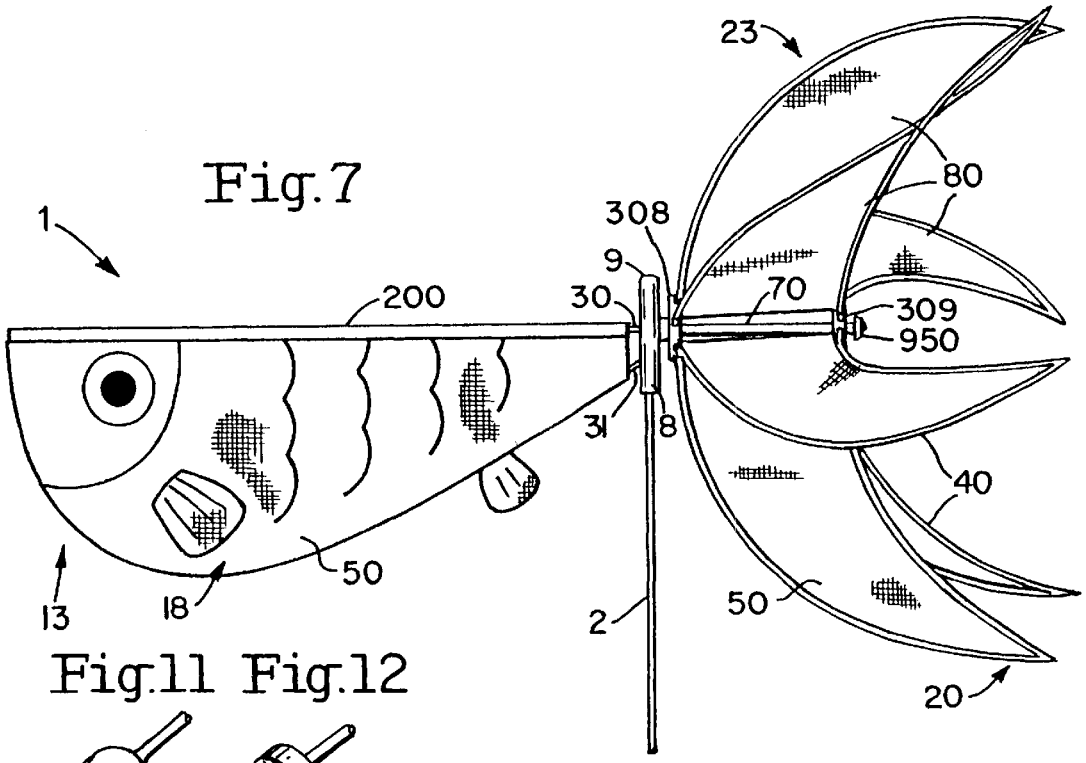
FIG. 7 is a side view of another embodiment of the invention.
Figures 11, 12:
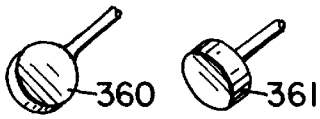
FIG. 11 is a perspective view of the bulbous headed structure.
FIG. 12 is a perspective view of the cylindrical headed structure.
Figure 13:
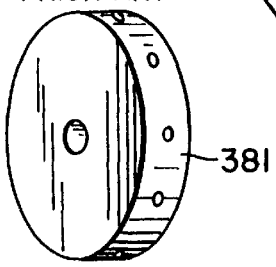
Fig.13 PRIOR ART
FIG. 13 is a perspective view of the cylindrical structure of the prior art.

Referring to FIGS. 1–19, a wind indicator toy 1 shown in FIGS. 1 and 2 has a ground stake 2, preferably having a pointed end 3, which can be pushed into the ground. An extension piece 4 can be attached to the top 5 of the ground stake 2 with the ground stake 2 and the extension piece 4 preferably having a male 6 and female 7 connector. At the top 8 of the extension piece 4 or at the top of the ground stake 2, there should be a pivot doll 9. The pivot doll 9 has a hole 10 drilled through its center 11 so that the pivot doll 9 can rotate atop the top of the stake 2 or the extension piece 4. The hole is not drilled completely through the pivot doll 9 at the end 12 of the pivot doll 9 so that the pivot doll does not slip down the stake 2.

Attached to the pivot doll 9 is a front section 13 which holds a directional indicator 14. The directional indicator 14 is a flexible piece of material 50, tightly stretched and supported by a frame 15. The flat piece of material can be in the shape of a bird 16, a dolphin 17, a fish 18, or any other identifiable form. The material 50 used can be nylon, silk, plastic, paper, cloth, or any other type of material which is flexible and durable. It is preferred that the material used be nylon. It is also preferred that the material 50 be made of, or dyed, with bright colors, making it more eye catching.

The frame 15 on which the material is shaped is made out of nylon, wood, or any other sturdy, flexible material. Additional flexible material can be added to outside of the frame to complete the image of the animal or object being portrayed. The frame 15 extends around the periphery or circumference of the material. In a preferred embodiment of the invention, there are two projections 30 and 31 at the end 32 of the frame 15. These two projections 30 31, which are preferably positioned close to each other, fit into holes 33 and 34 found on the pivot doll 9. These two projections reside in the same vertical plane.

Figure 8:
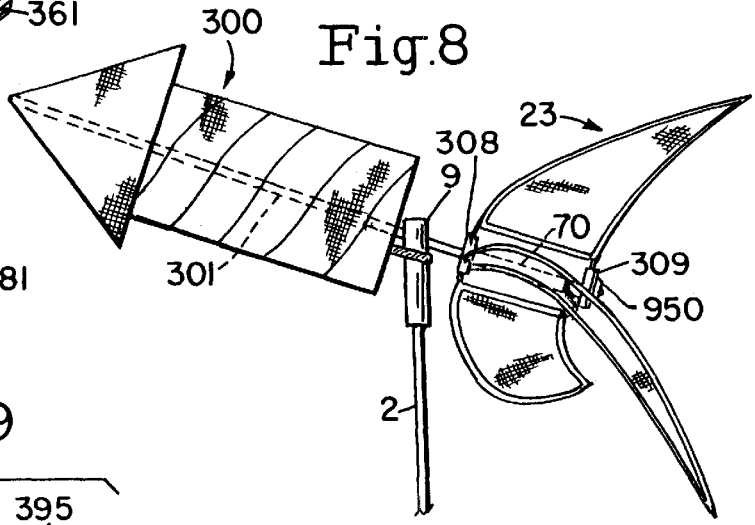
FIG. 8 is a cross view of another embodiment of the front section of the invention.
Figure 9:
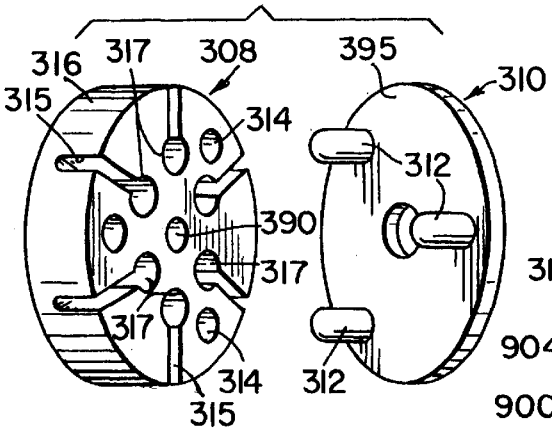
FIG. 9 is a perspective view of the hub lock.
Figure 10:
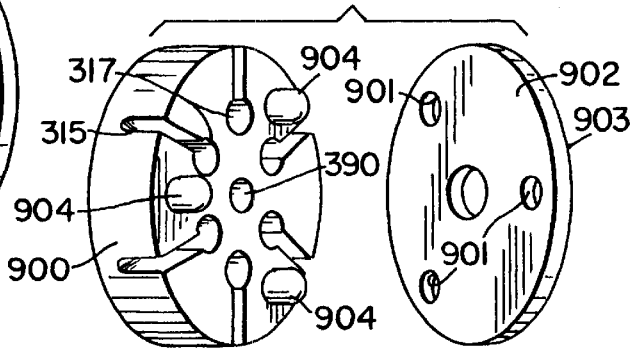
FIG. 10 is a perspective view of another embodiment of the hub lock.
Figure 14:
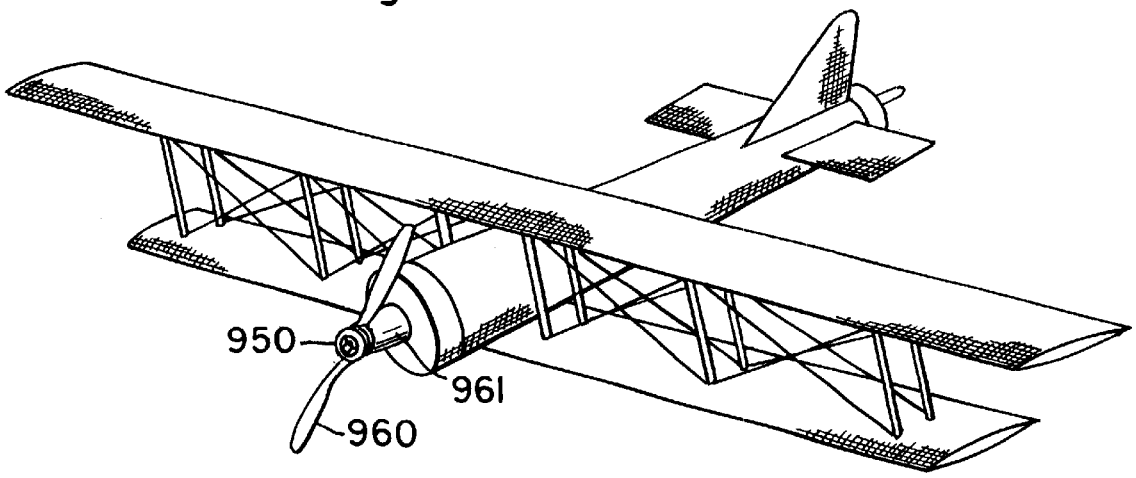
FIG. 14 is a perspective view of an airplane kite.
Figure 15:
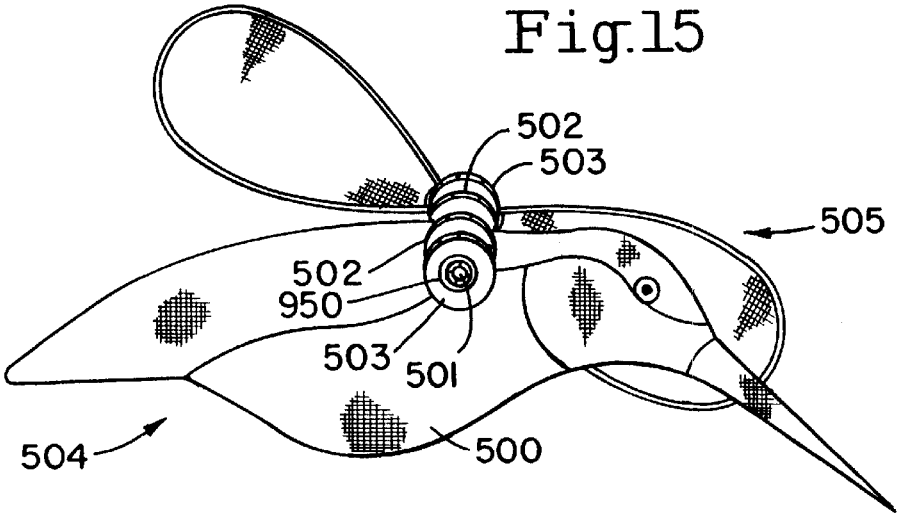
FIG. 15 is a perspective view of an alternative embodiment of a wind wheel.
Figure 16:
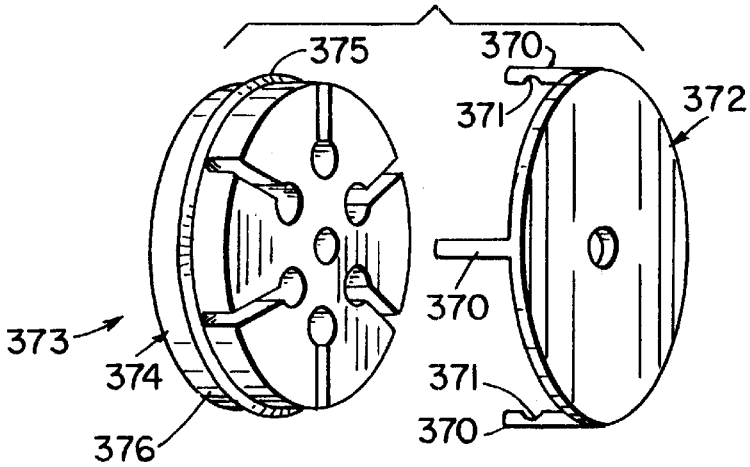
FIG. 16 is a perspective view of an alternative embodiment of a hub lock.
Figure 17:
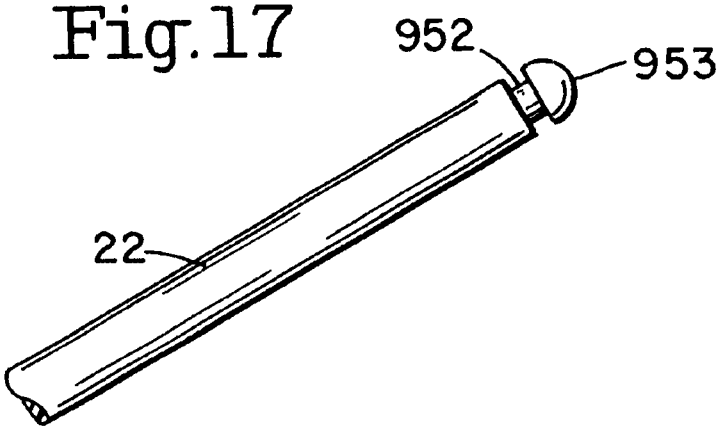
FIG. 17 is a perspective view of the rigid piece.
Figure 18:
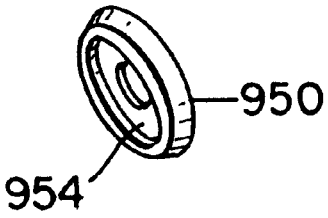
FIG. 18 is a perspective view of one embodiment of the locking mechanism.
Figure 19:
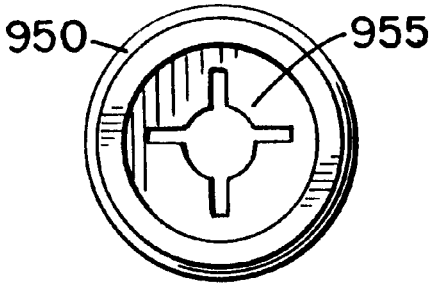
FIG. 19 is another perspective of the locking mechanism.

In an alternative version of the invention, as shown in FIG. 8, a framing structure can also, or alternatively be positioned inside 300 the shaped material, wherein a pocket 301 is formed. Projections 302 emanating from that pocket 301 fit into openings into the pivot doll 9.

In a preferred embodiment of the invention, a rigid piece 22, perpendicular and attached to the doll, supports a hollow rod 70 which supports at least one, and preferably several, wind catching tail(s) 23. The hollow rod 70 is kept from sliding off the rigid piece 22 by means of a locking mechanism 950 shaped like a washer but having an inner structure 951. The inner structure snaps securely into a groove 952 at the distal end 953 of the rigid piece 22. The inner structure 951 fits securely into the groove, insuring that the rotatable structures do not fall off of the kite or the wind wheel. The hollow rod 70 thus rotates freely about the rigid piece 22. This hollow rod 70 has at least one, and preferably two disk type hub locks 308 and 309 having central holes 390 through which the rigid piece 22 fits. The hub locks may be positioned at the proximal and distal ends of the rigid piece.

In one preferred embodiment of the invention, the locking mechanism 950 has an integrally connected inner circular section 954 which is fitted over the rigid piece 22, whereupon the inner circular section 954 "snaps" into the groove 952 positioned on the rigid piece 22.

In another embodiment of the invention, the locking mechanism 950 has integrally connected inner sections 955 which is fitted over the rigid piece 22, whereupon the inner sections 955 "snap" into the groove 952 positioned on the rigid piece 22.

This means for securing the hollow rod 70 is an improvement over the prior art. The use of the locking mechanism should prevent the hollow rod assembly from being blown off the wind wheel in high winds.

The two disk type hub locks 308 and 309 preferably have a "top" section 310 and a "bottom" section 311. In one embodiment of the invention, the top section 310 comprises a disk having prongs 312, preferably three prongs 312, usually pin shaped, projecting perpendicularly to the plane of the body 313 of the top section 310. The prongs extend downward from the underside 395 of the top section 312. The bottom section 311 has holes 314 which correspond with the prongs 312. The holes are only large enough to allow for the prongs 312 to fit tightly in the holes 314 of the bottom section 310. Alternatively, prongs 904 may extend from the bottom section 900 to fit into holes 901 positioned in the underside 902 of said top section 903.

The bottom section 310 has openings 315 positioned around the circumference 316 of the hub lock 308, 309. These openings 315 lead into large headed grooves 317.

The back section 20 of the wind wheel serves to capture the wind and thus rotates the entire top structure 21. In order to do this, at least one vane 80, and preferably numerous vanes, in the form of tail-like structures, are affixed to the back section 20, preferably attached to the two disk type structures hub like structures 308 and 309. The vane 80 comprises a piece of flexible material 60, tightly stretched and usually supported by a frame 40. The piece of material can be in the shape of a tail, fin or any other identifiable form. The material 60 used can be nylon, silk, plastic, paper, cloth, or any other type of material which is flexible and durable. It is preferred that the material used be nylon. It is also preferred that the material be made of, or dyed, with bright colors, making it more eye catching.

The frame 40 on which the material is shaped is made out of nylon, wood, or any other sturdy, flexible material. Additional flexible material can be added to outside of the frame to complete the image of the animal or object being portrayed. The frame 40 extends around the periphery or circumference of the material. In a preferred embodiment of the invention, there are at least one, and preferably two projections 60 and 61 at the ends 62, 63 of the frame 40 of the vanes 80. These two projections 60 and 61 fit into holes openings around the circumference 316 of hub locks 308 and 309. More specifically, and in the preferred embodiment of the invention, one projection fits into the one of the plurality of opening 315 of one of the hub locks 308, 309, and the other projection fits into one of the plurality of openings 320 of one of the other hub locks 308, 309. In the preferred embodiment of the invention, a bulbous 360 or cylindrical 361 head or structure is positioned at the end of the projections, fitting into the large headed grooves 316.

To insert the vanes, the top section 310 and the bottom section 311 of the hub locks 308 and 309 are separated. The projection 60, 61 of the vane is inserted in the appropriate slot, with the bulbous head 360 of the projection fitting into the head of the large headed grooves 317.

It should be noted that the holes or large headed grooves in the two disk type structures into which the two projections of the vains 80 do not have to be in alignment. Indeed, it may be preferable that the two projections 60, 61 at the ends 62, 63 of the frame 40 of the vains 80 not lie in the same plane with each other in relation to the plane of the hollow rod 70, thereby twisting the vane 80. This in turn allows the vain to catch the wind, and permits the hollow rod 70 about the rigid piece 22 to rotate and to direct the entire top structure 21.

It is preferred that the front section have a main supporting rod 200 which makes up part of the frame structure. This gives the device strength, and durability. This supporting rod may be an integral part of the frame of the structure.

In one preferred embodiment of the invention, the locking mechanism 950 is used to secure an airplane propeller 960 onto a hub 500 which rotates on a hollow tube around an extension piece.

Some wind wheels have a body 500, usually in the shape of an animal or bird, wherein a center stick 501 has, on each side, two hubs 502, 503 on each side 504, 505 of the body 500. The center stick goes through the pivot doll atop the extension piece. The hub locks can be used to hold the projections, and the vanes, in place. In this type of wind wheel, the vanes may be in the shape of wings, frog legs, or any other form. In these structures, a similar arrangement for the locking mechanism may be used to secure the hollow rods about the rigid piece.

It can not be overemphasized that the purpose of the locking mechanism does not prevent free movement of the hollow rods about the rigid piece. The locking mechanism does prevent the hollow tube from flying off of the rigid piece while rotating or during windy days.

Many modifications and variations of the present invention are possible in light of the above teachings. It is, therefore, to be understood within the scope of the appended claims the invention may be protected otherwise than as specifically described.

What is claimed is:

1. A wind indicator toy, said wind indicator toy comprising:

A) a ground stake; and

B) a top structure, said top structure comprising:

i) a pivot doll positioned on top of the ground stake;

ii) at least one rigid piece affixed to said pivot doll;

iii) at least one hollow rod which is placed over and rotates about said at least one rigid piece;

iv) at least one wind directed movable part;

iv) at least one circular hub lock for securing attachment of said at least one wind directed movable part said at least one circular hub lock being affixed to said hollow rod; and v) a groove positioned around a circumference of said at least one rigid piece; and vi) a snap lock to prevent said at least one hollow rod from slipping off said at least one rigid piece, said snap lock comprising a circular structure having an outer section and an inner section, said inner section being integral with said outer section and having a hole in the center, such that said at least one hollow rod is prevented from slipping off said at least one rigid piece when said snap lock is positioned over the at least one said rigid piece, said inner section being secured into said groove on said rigid piece.

2. The wind indicator toy of claim 1, wherein said circular hub lock comprises:

i) a top section, said top section having a hole through the center of said top section through which the frame is fitted ii) a bottom section, said bottom section having:

a) a second hole through the center of said bottom section through which the frame is fitted, said hole being in alignment with said hole of said top section, b) openings positioned around the circumference of said bottom section, wherein said projections are fitted to secure said wind directed movable parts;

c) large headed grooves, into which said holes lead; and

D) securing mechanism to removably secure said top section with said bottom section.

3. The wind indicator toy according to claim 2, wherein said large headed grooves have a bulbous shape.

4. The wind indicator toy according to claim 2, wherein said large headed grooves have a shape into which a cylinder shaped device fits.

5. The wind indicator toy according to claim 2, wherein said top section of said circular hub lock has prongs extending from an underside of said top section, and said bottom section has holes into which said prongs fit.

6. The wind indicator toy according to claim 2, wherein said bottom section of said circular hub lock has prongs which fit into holes in said top section of said circular hub lock.

7. The wind indicator toy according to claim 2, wherein said top section of said circular hub lock has resilient members integral with the sides of said top section, and said bottom section has a ridge, wherein said ridge snaps securely into the grooved tongue when the top section and the bottom section are aligned and pushed together.

8. The wind indicator toy according to claim 1, wherein said inner section of said snap lock is circular in shape.

9. The wind indicator toy according to claim 1, wherein said inner section of said snap lock is comprised of sections.

* * * * *